US005217032A

United States Patent [19]

Jobst

[11] Patent Number: 5,217,032

[45] Date of Patent: Jun. 8, 1993

[54] TRAY FOR INVALID'S WALKER FRAME

[76] Inventor: Robert J. Jobst, 8531 N. 27th Dr., Phoenix, Ariz. 85051

[21] Appl. No.: 834,413

[22] Filed: Feb. 11, 1992

[51] Int. Cl.[5] ..... A61H 3/00

[52] U.S. Cl. ..... 135/67; 297/5

[58] Field of Search ..... 135/65-67; 297/5, 6; 224/281, 42.32, 42.43, 42.44; 108/143, 43, 47, 48, 157

[56] References Cited

U.S. PATENT DOCUMENTS

| | | | |
|---|---|---|---|
| 1,394,224 | 10/1921 | Scott | 135/67 X |
| 2,759,525 | 8/1956 | Ries | 135/67 X |
| 3,516,425 | 6/1970 | Rigal | 135/67 |
| 4,251,044 | 2/1981 | Olson | 135/67 X |
| 4,452,484 | 6/1984 | Pastor | 135/67 X |
| 4,708,274 | 11/1987 | Roche | 135/67 X |
| 4,800,911 | 1/1989 | Endres et al. | 135/67 |
| 4,946,058 | 8/1990 | Stamm | 135/66 X |

*Primary Examiner*—Richard E. Chilcot, Jr.
*Assistant Examiner*—Lan M. Mai

[57] ABSTRACT

An invalid's walker frame is combined with a tray on which various items may be transported while the invalid's hands are engaged in maneuvering the walker frame. The tray is slide coupled in position such that the tray may be extended forward of the frame to allow a person to stand within the confines of the frame in the course of manipulating the frame. When desired, the person may draw the tray back more fully within the confines of the frame for use as a small table or work surface.

15 Claims, 2 Drawing Sheets

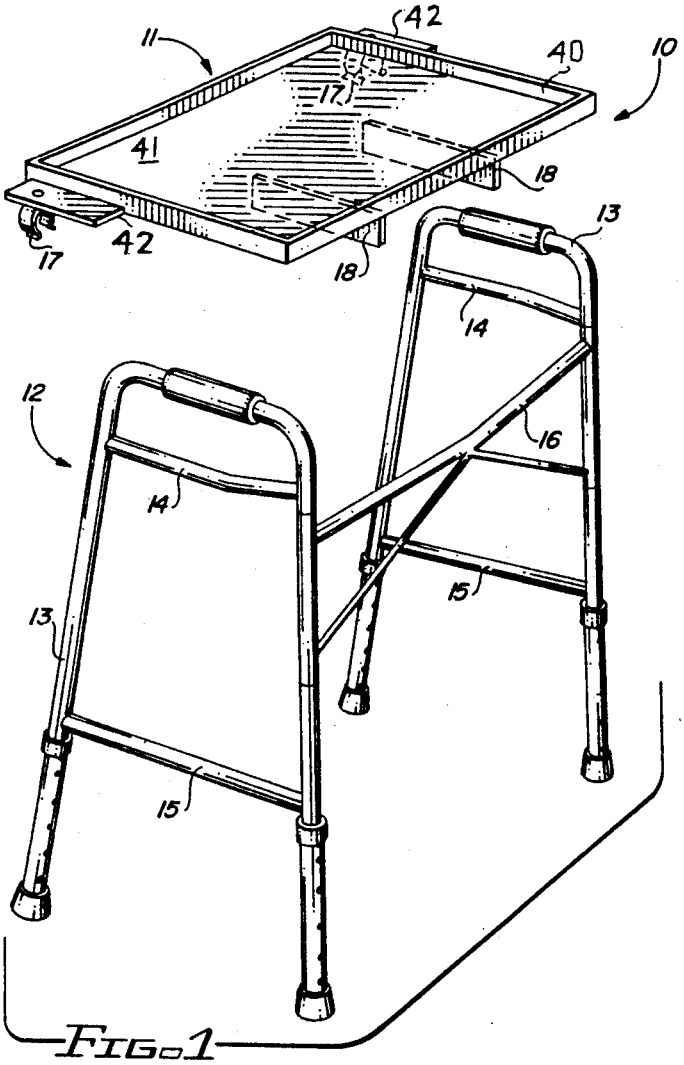
FIG. 1
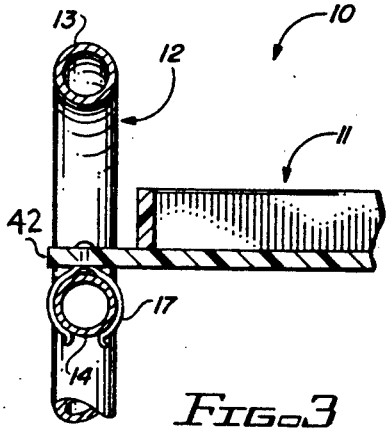
FIG. 3
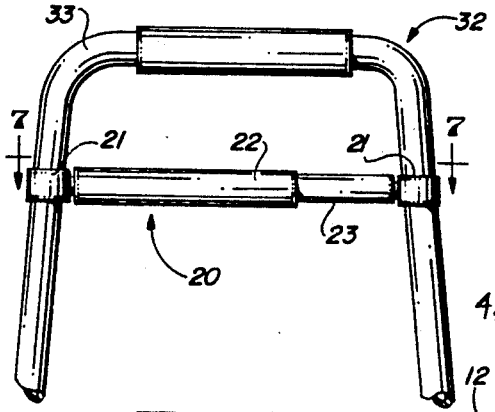
FIG. 6
FIG. 2
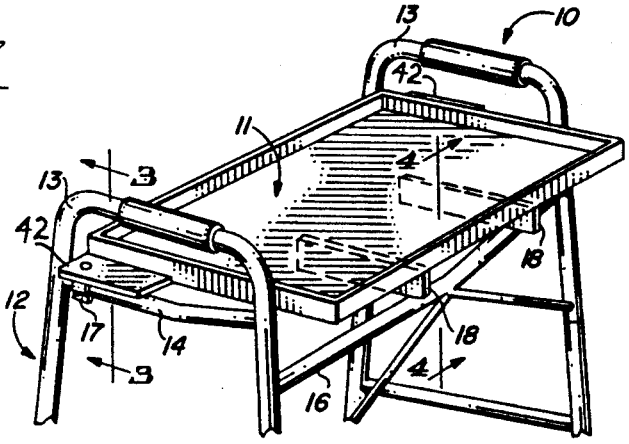

TRAY FOR INVALID'S WALKER FRAME

BACKGROUND

1. Technical Field of the Invention

The invention relates to the field of prosthetic walker frames utilized by persons having infirmities as an aid in providing support and stability to such persons in the course of their walking. In particular, the invention relates to a utility tray to be coupled to the walker frame to enable a person using the frame to transport items or food.

2. Prior Background Art

Persons experiencing problems with their legs or hips often resort to the use of a walking a frame to provide them partial support as they move from one place to another and to lend stability to themselves as they move or stand. The typical walker frame has a framework positioned at each side of the person's legs and topped with a hand grip. The two frames are joined together by additional framework at the front of the person. Thus, a person utilizing a walker frame enters a semi-enclosure made up of support framework to either side and in the front.

To utilize the frame, the person stands within the enclosure with left and right hand grasping the left and right hand grasp, respectively, of the frame at either side of the person. In his position, with the weight on the arms transferred through to the ground via the frame, stability is provided to enable a person to stand with some confidence. To move forward a person lifts the frame from the ground and places it slightly in front of himself. With his weight partially supported by the frame via the grasping of the hand holds, the person moves forward within the partial enclosure of the frame. Once positioned within the partial enclosure, the person repeats the process lifting the frame, advancing it and moving to within the enclosure again.

It is readily apparent that the use of a walker frame occupies a person's hands and arms and inhibits the use of a person's hands for carrying objects. Thus, although a person who has difficulty walking may be able to move about, for example, in the kitchen so as to prepare a meal for himself, he would be unable to transfer a plate of food, or the like, to a position where he could sit and enjoy the meal.

It is an object of the present invention to provide a walker with means for transport of items from one place to another while the person using the walker has his hands otherwise occupied in maneuvering the walker. It is the further object of the invention to provide a work surface which will always be conveniently at hand when a person is utilizing the walker or has it within reach.

SUMMARY DESCRIPTION OF THE INVENTION

In a first sense, the invention may be summarized as the combination of an invalid's walker frame and a tray. The walker frame has two side frames coupled together to permit an invalid to stand generally between the two side frames to utilize the walker frame for support in moving forward or rearward from one location to another. The tray has a support surface with means for slide coupling the tray to the walker frame between the two side frames.

The combination itself comprises the tray slide coupled to the walker frame between the two side frames and selectedly slide movable from a first position in which the tray is slidingly moved forward between the two side frames to permit an invalid access between the two side frames, to a second position in which the tray is slidingly moved rearward between the two side frames to permit the invalid convenient access to the support surface of the tray when not using the walker frame for support.

As disclosed each of the side frames of the walker frame further comprises a reinforcing cross member, the tray being slide coupled to the cross members for slide positioning between the two side frames. The walker frame further has a front bracing member joining the two side frames. Additionally, the tray further comprises slide contact support means in sliding contact with the front bracing member for providing support between the support surface of the tray and the walker frame.

In an alternate embodiment, the cross member is a supplemental reinforcing cross member, removably affixed to the side frame.

The invention may be summarized as an improvement in a walker frame useful in providing added support to a person moving from one location to another. The walker frame has first and second side frames between which side frames one grasping the side frames generally positions oneself for support. The improvement itself comprises means for transporting items on the walker frame while the walker frame is maneuvered to support a person and for maintaining items conveniently at hand when the walker frame is stationary.

The means for transporting items is a tray slide coupled to the walker frame for (a) slidable displacement forward between the first and the second side frames while one grasps the side frames for support while maneuvering the walker frame, and (b) slidable displacement rearward between the first and the second side frames for convenience of reaching the items while the walker frame is stationary.

In the improvement the first side frame further comprises a first reinforcing cross member, and the second side frame further comprises a second reinforcing cross member, the tray being slide coupled to the first and the second cross members for selected slidable displacement along the first and the second cross members. The walker frame further comprises a front bracing member joining the first and the second side frames; and, the tray further comprises slide contact support means making displaceable sliding contact with the front bracing member for providing additional slide displaceable support between the walker frame and the tray.

In an alternate embodiment of the improvement, the first reinforcing cross member is a supplementary cross member removably affixed to the first side frame and the second reinforcing cross member is a supplementary cross member removably affixed to the second side frame.

Finally, the invention may be seen as a method for assisting a person who requires the aid of a movable support in moving from one location to another, the method comprising the steps of:

providing a walker frame having first and second side frames between which a person may generally position herself while grasping the side frames for support and maneuvering the walker frame as she moves forward and rearward from one location to another;

joining the first and the second side frames with a front bracing member, and providing each of the first and the second side frames with a reinforcing cross member proximate the front bracing member;

making a tray with slide coupling means for slide coupling the tray to and between the reinforcing cross members of the first and second side frames; and slide coupling the tray to the cross members for selected forward and rearward slide displacement of the tray between the first and the second side frames.

Additionally, the step of making the tray further includes the step of making the tray with slide contact support means for making slidable support contact between the walker frame and the tray; and, the method itself includes the further step of using the slide contact support means to make slidable support contact with the front bracing member.

BRIEF DESCRIPTION OF THE DRAWINGS

FIG. 1 is an exploded assembly drawing, shown in perspective, of a walker frame with a tray which may be emplaced on the walker tray to enable the user of the frame to transport objects about while using the frame.

FIG. 2 is a partial perspective drawing illustrating the innovative tray coupled to the walker frame for use therewith.

FIG. 3 is a partial cross sectional view of the tray coupled to the walker frame taken along line 3—3 of FIG. 2.

FIG. 6 illustrates a supplementary cross member useful in adapting a walker frame having no such cross member to which a tray may be coupled.

DETAILS OF BEST MODE FOR CARRYING OUT THE INVENTION

Figure 4:
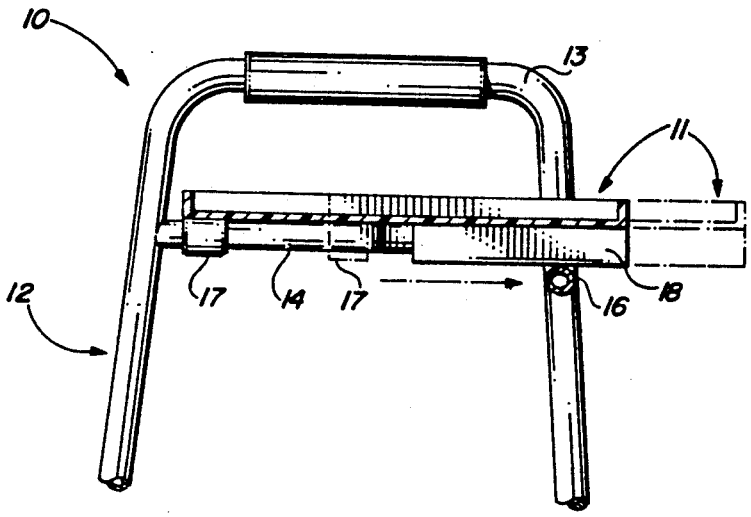
FIG. 4 is a partial cross sectional view showing the manner in which the tray is supported on the walker frame. Movement of the tray on the frame is indicated in phantom outline.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The invention 10, a tray 11 used in combination with an invalid's walker frame 12, is shown in perspective in FIG. 1, as an exploded assembly drawing, the tray 11 being removed from frame 12 and positioned above the frame, poised for installation thereon. Tray 11 has a raised rim 11 which generally encompasses a support surface 41. Surface 41 extends beyond encompassing rim 11 to provide two slide coupling extensions 42. Slide coupling clamps 17 affixed to the underside of each of extensions 42 provide means for slide coupling tray 11 to walker frame 12.

As will be disclosed, further support between tray 12 and walker frame 11 is furnished by slide supports 18 which extend downward from below surface 41 of tray 11.

Walker frame 12 is made up of two, upright, side frames 13. One or more cross members reinforce each of side frames 13, for example, upper cross member 14 and lower cross member 15, as best seen in FIG. 1. Side frames 13 are joined and further reinforced by truss-like front bracing 16. Although not shown in the illustrations, for clarity of detail in describing the invention, front bracing 16 is generally hinge coupled at each end to one of side frames 13. Such hinge coupling of brace 16 to side frames 13 permits each of side frames 13 to be rotated inwardly toward the other so as to form an essentially flat structure with each side frame overlapping in near parallel alignment with front bracing 16. Such folding capability is not necessary to the functioning of the invention.

To utilize the invention, tray ;1 is tipped downward into the space between the two side frames 13, positioning slide coupling extensions 42 above upper cross members 14 of walker frame 12, with a slide coupling clamp 17 in general alignment with each of those upper cross members. A downward pressure exerted on each of slide coupling extensions 42 engages slide coupling clamps 17 with their associated upper cross member 4, as shown in FIGS. 2-5. When clamps 17 so engage cross members 14, slide supports 18, extending downward below surface 41 of tray 11, come to rest atop front bracing 16 of walker frame 12 to supply a forward, centralized support for tray 11. See FIGS. 2, 4 and 5.

The mechanics of the assembly is readily seen in the side, sectional view of FIG. 4. Here clamp 17 is seen to be slide coupled to cross member 14. The downwardly directed supports 18 rest in slide contact atop front bracing 16. By sliding tray 11 forward, i.e., to the right of FIG. 4, tray 11 moves to the position shown in phantom outline. The ability to vary the position of tray 11 on walker frame 12 is best seen by comparison of FIG. 2 and FIG. 5.

Figure 5:
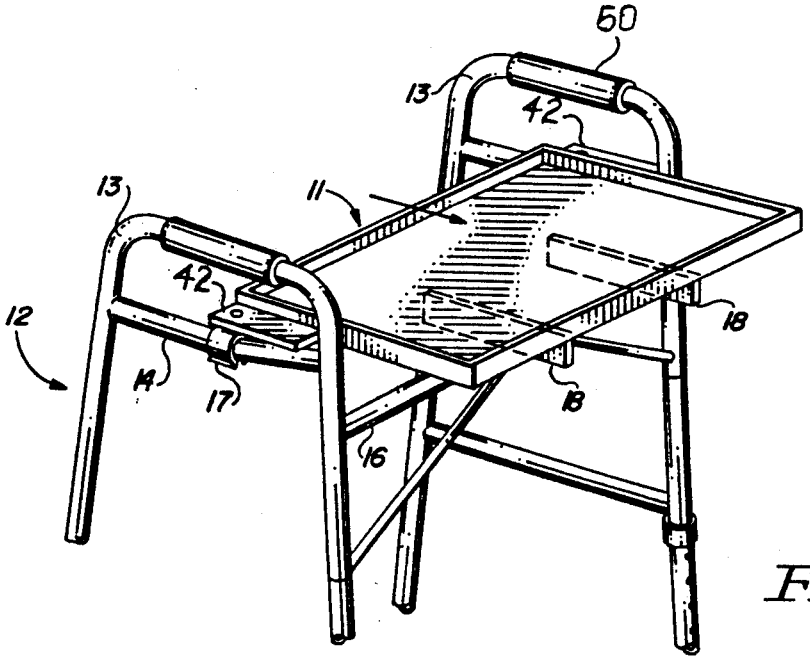
FIG. 5 is a partial perspective drawing indicating the manner in which the position of the tray, coupled to the walker frame, may be advanced forward of the frame to enable the user of the frame to step within the partial enclosure provided by the frame.

In the tray position shown in FIG. 5, a person requiring the aid of walker frame 12 will position herself between side frames 13. The foreword position enables her to stand between side frames 13 grasping frame handles 50. She then moves walker frame 12 forward, and, using the frame for support, she moves forward herself to again position herself between side frames 13. The exercise is repeated as the person moves from one location to another.

Because use of walker frame 12 requires a person to use both hands to hold the hand grips 50 of walker frame 12, the presence of tray 11 on the walker frame permits the person to transport food, drink, knitting, reading materials, etc as she moves with the frame. When the person arrives at a desired location at which she may sit, she does so, draws walker frame 12 towards herself, then slides tray 11 on walker frame 12 to a position close and convenient to her.

Some walker frames, for example, walker frame 32 of FIG. 6 lack the upper cross member 14 of walker frame 12. To enable the use of walker frame 32 with tray 11, a supplementary cross member 20 is made available. Cross member 20 is made up of outer cylinder 22 into which is slidingly inserted inner cylinder 23. By adjusting the depth to which inner cylinder 23 is inserted into cylinder 22, a cross member of desired length is obtained. Cross member 20 is thus an adjustable length cross member.

Figure 7:
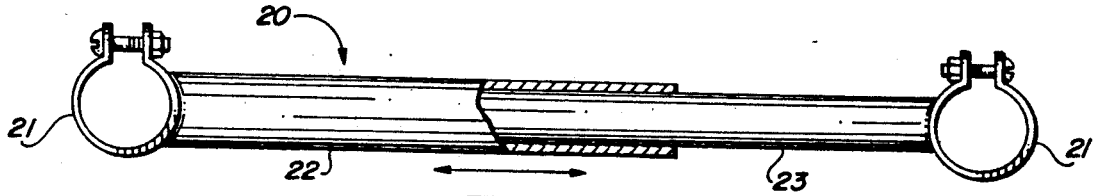
FIG. 7 is a partial cross sectional view of the supplemental cross member of FIG. 6 showing the manner in which it may be clamped to a walker frame and by which it may be adjusted in length.

Each end of adjustable length cross member 20 is equipped with a clamp 21, see FIG. 7, which is fixedly, but removably, coupled to side frame 33 of walker frame 32. Once walker frame 32 is equipped with adjustable length cross members 20, tray 11 may be utilized with frame 32 in the manner just disclosed with respect to walker frame 12.

What has been disclosed is the combination of an invalid's walker frame and a tray on which various items may be transported while the invalid's hands are engaged in manipulating the walker frame. The tray is slide coupled in position such that the tray may be extended forward of the frame to allow a person to stand within the confines of the frame in the course of manipulating the frame. When desired, the person may draw the tray back more fully within the confines of the frame for use as a small table or work surface.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, that which is claimed is:

1. The combination of an invalid's walker frame and a tray, said walker frame comprising two side frames each having a front edge coupled together to permit an invalid to stand generally between said two side frames to utilize said walker frame for support in moving forward or rearward from one location to another;

said tray having a support surface with means for slide coupling said tray to said walker frame between said two side frames;

said combination comprising said tray slide coupled to said walker frame between said two side frames and selectedly slide movable from a first position in which said tray is slidingly moved forward from between said two side frames to permit an invalid access between said two side frames, to a second position in which said tray is slidingly moved rearward in between said two side frames to permit said invalid convenient access to said support surface of said tray when not using said walker frame for support wherein a portion of said tray extending beyond said front edge of said side frames.

2. The combination of claim 1 wherein each said side frame of said walker frame further comprises a reinforcing cross member, said tray being slide coupled to said cross members for slide positioning between said two side frames.

3. The combination of claim 2 wherein said walker frame further comprises a front bracing member joining said two side frames and said tray further comprises slide contact support means in sliding contact with said front braking member for providing support between said support surface of said tray and said walker frame.

4. The combination of claim 2 wherein said cross member is a supplemental reinforcing cross member, removably affixed to said side frame.

5. The combination of claim 1 wherein said walker frame further comprises a front bracing member joining said two side frames and said tray further comprises slide contact support means in sliding contact with said front bracing member for providing support between said support surface of said tray and said walker frame.

6. In a walker frame useful in providing added support to a person moving from one location to another and having first and second side frames each having a front edge and between which side frames one grasping said side frames generally positions oneself for support the improvement comprising:

means for transporting items on said walker frame while said walker frame is maneuvered to support a person and for maintaining items conveniently at hand when said walker frame is stationary;

said means for transporting items comprising a tray slide coupled to said walker frame for (a) slidably displacement forward out from between said first and said second side frames while one grasps said side frames for support while maneuvering said walker frame wherein a portion of said tray extending beyond said front edge of said side frames, and (b) slidably displacement rearward back in between said first and said second side frames for convenience of reaching said items while said walker frame is stationary.

7. The improvement of claim 6 wherein said first side frame further comprises a first reinforcing cross member, and said second side frame further comprises a second reinforcing cross member, said tray being slide coupled to said first and said second cross members for selected slidably displacement along said first and said second cross members.

8. The improvement of claim 7 wherein said first reinforcing cross member is a supplementary cross member removably affixed to said first side frame and said second reinforcing cross member is a supplementary cross member removably affixed to said second side frame.

9. The improvement of claim 7 wherein said walker frame further comprises a front bracing member joining said first and said second side frames and said tray further comprises slide contact support means making displaceable sliding contact with said front bracing member for providing additional slide displaceable support between said walker frame and said tray.

10. The improvement of claim 9 wherein said first reinforcing cross member is a supplementary cross member removably affixed to said first side frame and said second reinforcing cross member is a supplementary cross member removably affixed to said second side frame.

11. A walking frame for providing partial support and stability to a person comprising:

a left and a right framework positioned one at each side of said person's legs said left and right frameworks each having a front edge;

a left and a right handgrip positioned one each on said respective left and right frameworks, each said handgrip for grasping by the hand of said person using said walker frame for transferring said person's weight through his arms to said handgrips and framework to the ground, and for lifting said walker frame from the ground as said person advances;

a coupling framework joining said left and said right frameworks, said left framework and said right framework and said coupling framework forming a semi-enclosure about the left, right, and front of a person using said walking frame;

a tray slide coupled to said left and said right framework;

(a) for slidably displacement outward from said semi-enclosure to enable said person to enter said semi-enclosure to use said walker frame wherein a portion of said tray extending beyond said front edge of said left and right frameworks, and (b) for slidably displacement inward within said semi-enclosure when said person exits said semi-enclosure.

12. The walking frame of claim 11 wherein said left framework further comprises a first reinforcing cross member, and said right framework further comprises a second reinforcing cross member, said tray being slide coupled to said first and said second cross members for selected slidable displacement along said first and said second cross members.

13. The walking frame of claim 12 wherein said first reinforcing cross member is a supplementary cross member removably affixed to said left framework and said second reinforcing cross member is a supplementary cross member removably affixed to said right framework.

14. The walking frame of claim 12 wherein said walking frame further comprises a front bracing member joining said left and said right frameworks and said tray further comprises slide contact support means making displaceable sliding contact with said front bracing member for providing additional slide displaceable support between said walker frame and said tray.

15. The walking frame of claim 14 wherein said first reinforcing cross member is a supplementary cross member removably affixed to said left framework and said second reinforcing cross member is a supplementary cross member removably affixed to said right framework.

* * * * *